United States Patent [19]

Yoshioka et al.

[11] 4,414,529

[45] Nov. 8, 1983

[54] THERMAL SWITCH

[75] Inventors: Hideoki Yoshioka; Ichiro Okino; Toshiaki Toda, all of Osaka, Japan

[73] Assignee: Matsushita Electric Works, Ltd., Osaka, Japan

[21] Appl. No.: 311,944

[22] Filed: Oct. 16, 1981

[30] Foreign Application Priority Data

Dec. 10, 1980 [JP] Japan ..... 55-173977

[51] Int. Cl.[3] ..... H01H 37/54

[52] U.S. Cl. ..... 337/365; 337/371; 337/372

[58] Field of Search ..... 337/370, 371, 372, 365, 337/367

[56] References Cited

U.S. PATENT DOCUMENTS 2,727,962 12/1955 Vaughan ..... 337/379 X 2,864,918 12/1958 Epstein ..... 337/379 X 4,149,138 4/1979 Pevzner et al. ..... 337/372

*Primary Examiner*—George Harris

*Attorney, Agent, or Firm*—Burns, Doane, Swecker & Mathis

[57] ABSTRACT

A thermal switch comprising a plurality of outer terminals respectively having a fixed contact, a movable contact spring divided into a plurality of mutually parallel contact spring parts each having a movable contact for contacting with and separating from the fixed contact and a plurality of bimetals respectively operating at differently set temperatures and provided so as to independently actuate the respective contact spring parts, whereby resetting-type contacts are reliably opened and closed in response to fluctuations in the atmospheric temperature through one of the bimetals which has a relatively lower first set-temperature and, when the particular bimetal of the relatively lower first set-temperature fails to operate and the atmospheric temperature further rises, non-resetting-type contacts are reliably opened through the other bimetal having a relatively higher second set-temperature.

11 Claims, 25 Drawing Figures

113
127
130
137
126
114
128
136
XIII
XIII 133
126
128
113
136
144

241
227
237
236
226
240

336,337
361
326
319
340

THERMAL SWITCH

This invention relates to thermal switches responsive to predetermined atmospheric temperatures and, more particularly, to a thermal switch which is operatable at different set termperatures.

In this thermal switch of the kind referred to, a movable contact spring is provided also with a reversing bimetal which reversely tunes by itself at a predetermined atmospheric temperature so that, when the atmospheric temperature around the switch reaches this set temperature, the reversing bimetal will reverse and a movable contact secured to the movable contact spring will be thereby separated from an opposing fixed contact to open the contacts. Thus, when the atmospheric temperature rises to be abnormal, a circuit connected to this thermal switch will be cut off from an electric power source and an instrument or the like associated with this circuit can be protected from the abnormal temperature.

In the above described formation, however, the protecting operation is to be performed with a single reversing bimetal and there has been a risk that, when the operation of the reversing spring is made impossible due to a fusing between the contacts, damage of the reversing spring itself or the like trouble, the function of the thermal switch will not be achieved any more.

A primary object of the present invention is, therefore, to provide a thermal switch whereby even if the contacts are fused together or an employed bimetal is broken, an associated circuit will be positively cut off and the instrument or the like connected to this circuit can be reliably protected.

Another object of the present invention is to provide a thermal switch wherein a pair of bimetals of different set-temperatures are provided so as to be respectively independently contributive to the opening and closing of the contacts and can perform a double safety function when utilized as an excess temperature rise preventer.

A further object of the present invention is to provide a thermal switch wherein a pair of bimetals different in the set-temperatures are effectively parallelly provided so as to have a function of remarkably improving the reliability and safety and yet can be arranged compactly.

Still another object of the present invention to provide a thermal switch having an arrangement for reliably stably holding bimetals at their predetermined positions causing no positional fluctuation so that stable operational characteristics of the bimetals can be assured.

Other objects and advantages of the present invention shall be made clear in the following explanations of preferred embodiments detailed with reference to accompanying drawings, in which:

FIG. 1(*b*) is a plan view of a bimetal used in the switch of FIG. 1(*a*);

FIG. 6(*b*) is an explanatory view for the bimetal shown in FIG. 6(*a*);

Figure 11A:
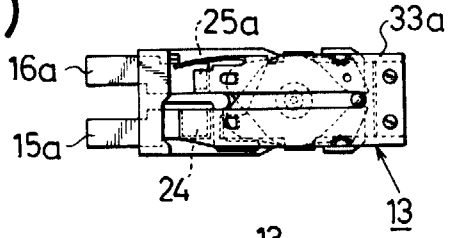
Figure 11B:
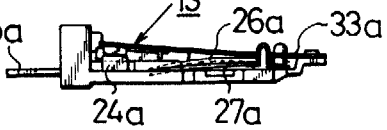
Figure 8A:
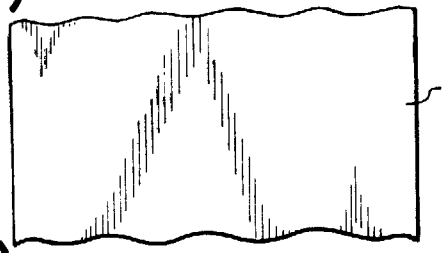
Figure 8B:
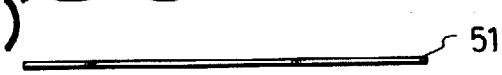
Figures 12, 13, 14, 15:
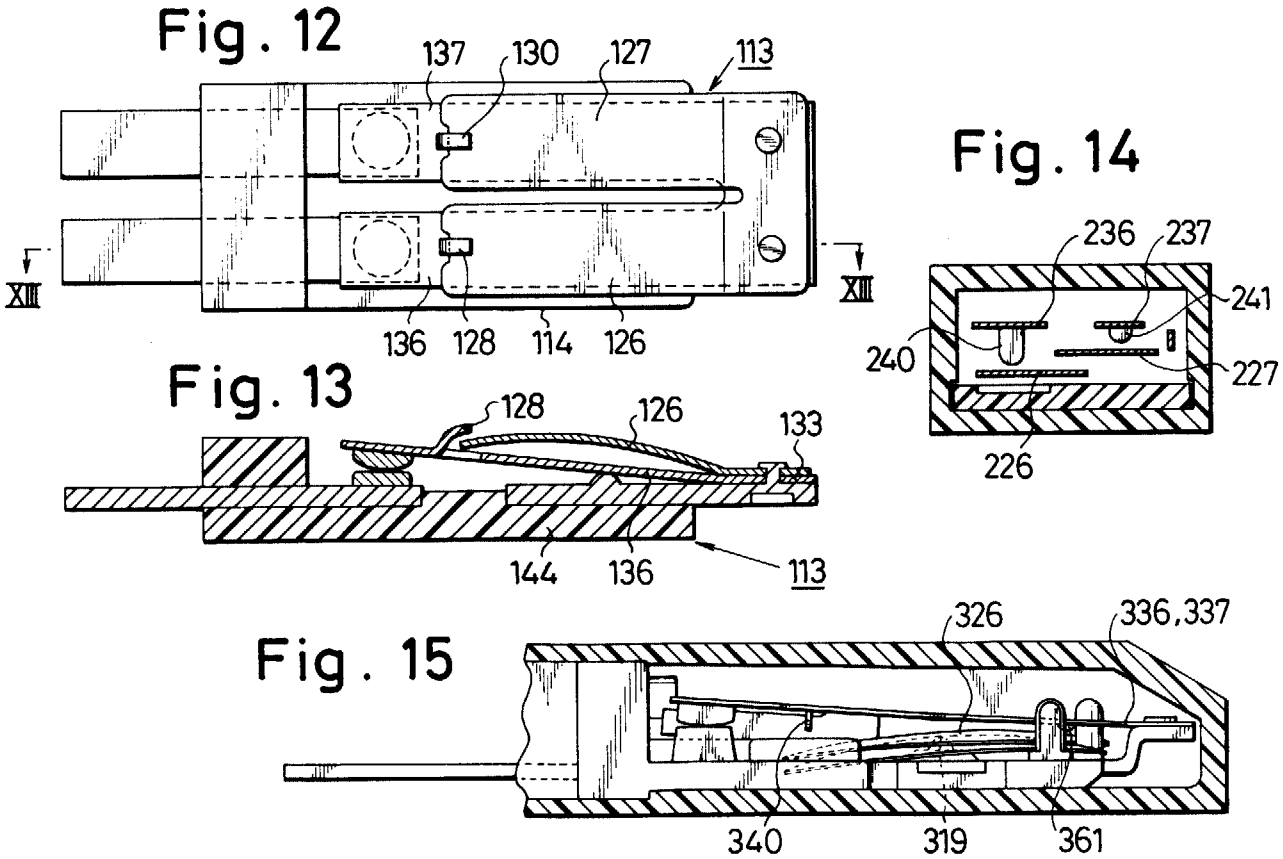

FIGS. 8(*a*) and 8(*b*) through FIGS. 11(*a*) and 11(*b*) are views showing respective sequences of the process of manufacturing the thermal switch of FIGS. 2 to 5;

FIG. 12 is a plan view of still another embodiment of the thermal switch according to the present invention with a housing removed;

FIG. 13 is a sectioned view of the switch shown in FIG. 12 along line XIII—XIII therein;

FIG. 14 shows in cross sectioned view of a further embodiment of the thermal switch according to the present invention;

FIG. 15 is an internal side view of a still further embodiment of the thermal switch according to the present invention; and FIGS. 16 and 17 and FIGS. 18 and 19 are schematic side views of other respectively different embodiments of the present invention.

While the present invention shall now be explained in the followings with reference to the respective embodiments shown in the drawings, it should be understood that the present invention is not to be limited to these embodiments shown but the intention is to include all modifications, alterations and equivalent arrangements possible within the scope of appended claims.

Figure 1A:
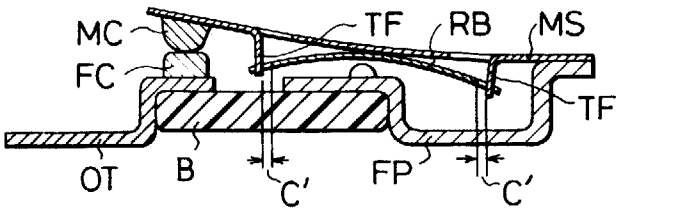
Fig. 1(a) (PRIOR ART)
FIG. 1(*a*) is a fragmentary sectioned view showing a main part arrangement of a known thermal switch.
Figure 1B:
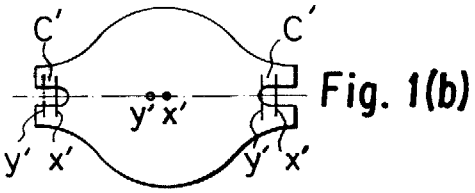

In order to facilitate a better understanding of the thermal switch according to the present invention, a conventional thermal switch shall be explained first with reference to FIG. 1. In this known thermal switch, an outer terminal OT having a fixed contact FC and a movable-spring fixing plate FP are fixed respectively at one end to a base B, and a movable spring MS is fixed at its base end to the other end of the movable spring fixing plate FP. A movable contact MC which can be brought into contact with and separated from the fixed contact FC of the outer terminal OT is secured to the free end of the movable spring MS, and a pair of tongue pieces TF cut and raised from the movable spring MS as mutually separated are engaged respectively in each of slots made in axially opposing edges of a single reversing bimetal RB operating to reverse by itself at a predetermined set-temperature. When the atmospheric temperature reaches the set-temperature, the reversing bimetal RB will turn or lean back so as to deviate reversely from illustrated state since the bimetal abuts substantially at its central point against the base, whereby the movable spring MS is pushed up and the movable contact MC is separated from the fixed contact FC to open the contacts.

In this arrangement of FIG. 1, however, there are such defects that, as only the single reversing bimetal RB is used, the contacts FC and MC become easily unable to be separated when they are fused together with a force enough for resisting against the reversing force of the bimetal RB and, on the other hand, the reversing force of the bimetal RB will become insufficient or nil when the bimetal is cracked or broken so that the contacts cannot be separated from each other any more. For the purpose of allowing the bimetal to turn back and forward, further, a clearance C′ is necessarily provided between the innermost edge of the respective slots in the bimetal RB and each of the tongue pieces TF engaged in the slots and, upon the turning operations, the abutting point substantially at the center of the bimetal with the base and engaging points of the bimetal with the tongue pieces are caused to deviate between respective points x' and y' shown in FIG. 1(*b*), whereby there are caused to arise such problems that the turning operations involve fluctuations, the operations are caused to become unstable and so on.

According to an aspect of the present invention, therefore, a plurality of, for example, two of reversing bimetals are provided and the respective reversing bimetals are made to have a different set-temperature, that is, a turning temperature different from the other, so as to keep the switching point to be stable and to enable it possible to render a plurality set of, for example, two sets of resetting-type or non-resetting type switching contacts to be actuatable respectively independent of each other.

In FIGS. 2 to 5, there is shown a typical embodiment of the thermal switch according to the present invention. This thermal switch is provided with a box-shaped housing 11 opened at one end. On the inside surfaces of both side walls of this housing 11, guide grooves 12 are formed so as to extend horizontally in the lengthwise direction of the housing 11, a switch body 13 is fitted into the housing as guided along the guide grooves 12 to be smoothly and stably contained therein.

The switch body 13 comprises an elongated base 14 made by molding a synthetic resin with respect to a continuous strip of a conductive metal plate preferably subjected to a punching work (an optimum example of manufacturing process shall be described later). A main outer terminal 15 and auxiliary outer terminal 16 are extended in a pair in the lengthwise direction of the base 14 at one end of the base 14 and are electrically independently held by the synthetic resin molding. A movable-spring fixing plate 17 having a stepped part at the free end is extended at the other end of the base 14 and is held by the synthetic resin molding electrically independently of the both terminals 15 and 16. Substantially in the middle of the base 14, a projecting base 18 slightly expanded above the surface of the base 14 is provided and further a small push-up projection 19 is provided as erected upward of the projecting base 18. On the other hand, at the end edge of the base 14 from which the both terminals 15 and 16 are extended, such end-wall-forming part 20 that can close the open end of the housing 11 is provided to project vertically upward. In the middle of the other end edge of the base 14 from which the movable-spring fixing plate 17 is extened, a columnar supporting projection 21 is provided as erected also upward and, at the respective side edges of the same end of the base, semi-columnar locking projections 22 and 23 are similarly so that respective equal distances will be set from the supporting projection 21 and the lines connecting these projections 21 to 23 will describe an isosceles triangle.

Figure 6A:
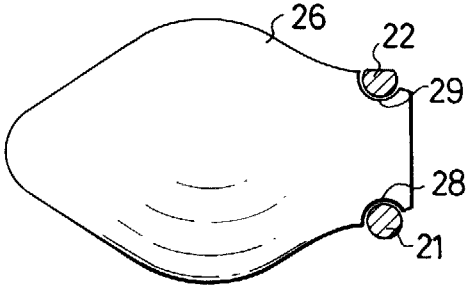
FIG. 6(*a*) is a plan view of a reversing bimetal used in the thermal switch shown in FIG. 2.
Figure 6B:
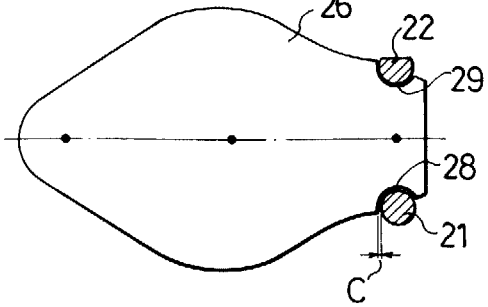
Figure 7:
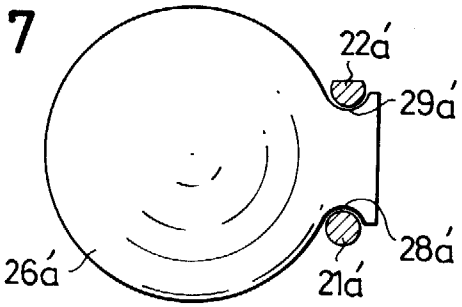
FIG. 7 is a plan view of another embodiment of the reversing bimetal in the thermal switch according to the present invention.

Further, at the respective inner ends located inside the end-wall-forming part 20 of the main and auxiliary outer terminals 15 and 16, main and auxiliary fixed contacts 24 and 25 are secured, respectively. On the other hand, on the base 14, respectively concaved main and auxiliary reversing bimetals 26 and 27 different from each other in the set-temperature, that is, the operating temperature are mounted. These main and auxiliary reversing bimetals 26 and 27 may be formed substantially to be oval or elliptic as seen in the plan, specifically as shown in FIG. 6(*a*), or to be substantially circular specifically as shown in FIG. 7. In these drawings, only the main reversing bimetal 26 is exemplified. In the embodiment of FIG. 7, further, the same functioning parts as is FIG. 6(*a*) are identified by the same numbers but with a suffix a' attached. Further in the present embodiment, the operating temperatures of the two bimetals are so selected that the main reversing bimetal 26 will operate at a first set-temperature relatively lower and the auxiliary reversing bimetal 27 will operate at a second set-temperature relatively higher.

In the respective base parts of the main and auxiliary reversing bimetals 26 and 27, there are formed incisions 28, 29 or 30, 31 which are engageable with the supporting projection 21 and locking projection 22 or 23. When the incisions 28 and 29 or 30 and 31 are engaged with the supporting and locking projections 21 and 22 or 21 and 23, the main and auxiliary reversing bimetals 26 and 27 will extend at their tip end respectively toward the side end edge of the base opposite to the side end edge on which the locking projection 22 or 23 is positioned. That is, when the main and auxiliary reversing bimetals 26 and 27 are engaged at the base ends with the projections 21 and 22 or 22 and 23, they will overlap on each other with their most part as seen in the plan and will extend as intersected with each other at the tips toward the opposed side end edge of the base 14 as shown by dotted lines in FIG. 3. Further, a hole 32 through which the small push-up projection 19 can be inserted is made in the center of the auxiliary reversing bimetal 27 so that the main and auxiliary reversing bimetals 26 and 27 will be compactly provided together as separated from each other in the overlapped vertical relation.

On the other hand, on the stepped part at the extended end of the movable-spring fixing plate 17, the movable contact spring 33 is secured at the base end preferably by means of fitting dowels 34 and 35 of the plate 17 into holes made at the base end of the spring. The movable contact spring 33 is forked into two so as to have a main contact-spring part 36 and auxiliary contact-spring part 37 extending in parallel with each other. A main movable contact 38 and auxiliary movable contact 39 contactable respectively with the main and auxiliary fixed contacts 24 and 25 secured respectively to the main and auxiliary outer terminals 15 and 16 are fixed respectively to the free ends of the main and auxiliary contact-spring parts 36 and 37. A main tongue piece 40 and auxiliary tongue piece 41 extending downward substantially at right angles and different in the length from each other are provided as cut and raised respectively in the main and auxiliary contact-spring parts 36 and 37 so as to be positioned respectively slightly above the tips of the main and auxiliary reversing bimetals 26 and 27 at the normal state.

According to another aspect of the present invention, there is provided a means for restraining an automatic contact closing operation from being performed and thus preventing the opened contacts from being restored to the closed state, so as to provide a non-resetting type arrangement, specifically when the bimetal is operated at the relatively higher set-temperature. Therefore, a return-preventing tongue piece 42 extended in the lengthwise direction and directed vertically is provided on one side edge of the auxiliary contact-spring part 37, whereas the base 14 is provided with a return-preventing shelf part 43 projected upward preferably at a position adjacent the inside surface of the end-wall-forming part 20 so that, when the auxiliary contact-spring part 37 moves upward, the return-preventing tongue piece 42 of the auxiliary contact-spring part 37 will ride on the shelf part 43. That is, this shelf part 43 is so formed that, when the auxiliary contact-spring part 37 moves upward, the tongue piece 42 will slide along the vertical side surface 44 of the shelf part 43 and then ride on the horizontal shelf surface 45 while being prevented from escaping out of the surface 45 by a tapered surface 46 extending diagonally upward from the surface 45.

Figure 4:
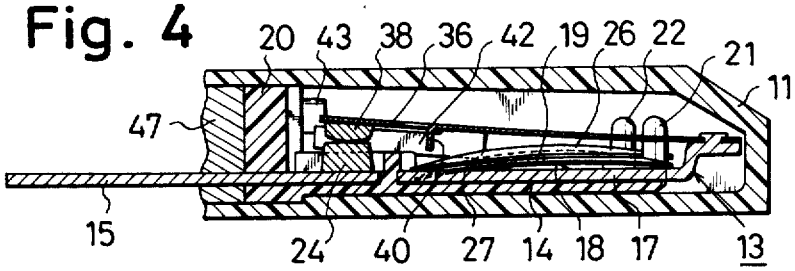
FIG. 4 is a vertically sectioned view of the switch of FIG. 2 as seen on line IV—IV shown in FIG. 3.
Figure 5:
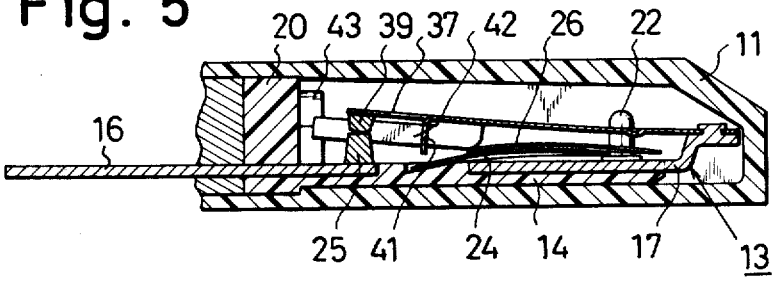
FIG. 5 is a vertically secitoned view of the switch of FIG. 2 as seen on line V—V shown in FIG. 3.

After the switch body 13 is inserted in the housing 11, the open end of the housing 11 primarily closed by the end-wall-forming part 20 of the base 14 is further filled with a sealing binder 47 outside the end-wall-forming part 20 as seen in FIG. 4 or 5.

Figure 10A:
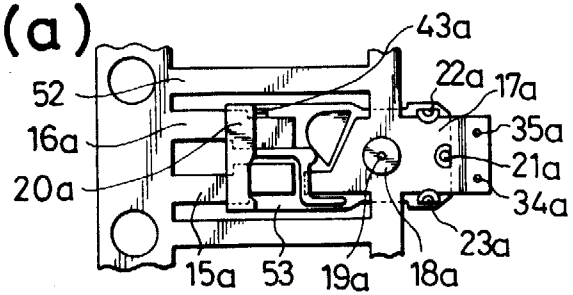
Figure 10B:
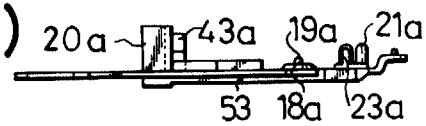
Figure 9A:
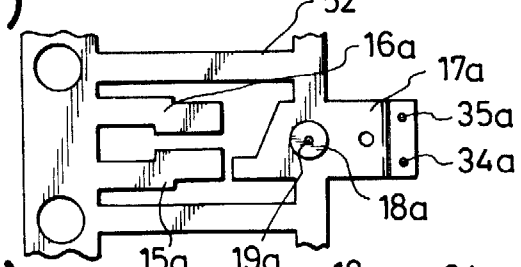
Figure 9B:
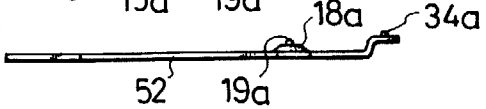

Here, a preferred process of manufacturing the foregoing switch body 13 shall be referred to. First, such conductive metal plate 51 as shown in FIGS. 8(*a*) and 8(*b*) is subjected to a punching work so that main and auxiliary outer terminal parts 15*a* and 16*a* and a movable-spring fixing plate part 17*a* will be formed in the plate 51 as integrally connected with one another through connecting parts 52 as shown in FIGS. 9(*a*) and 9(*b*). At the same time, as also shown in these drawings, a step is formed as bent at an extended end of the movable-spring fixing plate part 17*a*, a slightly projected base part 18*a* is formed as pressed out and a small push-up projection part 19*a* and dowel parts 34*a* and 35*a* are also dowel-formed. Futher, as shown in FIGS. 10(*a*) and 10(*b*), a synthetic resin mold 53 is formed while the main and auxiliary outer terminal parts 15*a* and 16*a*, movable-spring fixing part 17*a*, end-wall-forming part 20*a*, return preventing shelf part 43*a*, supporting projection part 21*a* and locking projections 22*a* and 23*a* are being simultaneously formed. In addition, as shown in FIGS. 11(*a*) and 11(*b*), main and auxiliary fixed contact members 24*a* and 25*a* are fixed respectively to the main and auxiliary outer terminal parts 15*a* and 16*a*, then the connecting parts 52 are cut off and main and auxiliary reversing bimetal members 26*a* and 27*a* and a movable contact spring member 33*a* are properly arranged in positions, whereby the switch body 13 is assembled.

The function of the foregoing embodiment shown in the above described FIGS. 2 to 5 shall be referred to next. In this embodiment, an electric circuit is formed of the main outer terminal 15, main fixed contact 24, main movable contact 38, main and auxiliary contact-spring parts 36 and 37 of the movable contact spring 33, auxiliary movable contact 39, auxiliary fixed contact 25 and auxiliary outer terminal 16. Now, when the atmospheric temperature of an instrument provided with the thermal switch reaches the relatively lower first set-temperature (for example, an operating temperature of known thermal switches) for the main reversing bimetal 26, the particular bimetal operates to reverse and the main contact-spring part 36 will be pushed up through the main tongue piece 40, whereby the main movable contact 38 of the main contact-spring part 36 is separated from the main fixed contact 24 fixed to the main outer terminal 15 and the contacts are opened. Since this operation is to be repeated at every operation of the main bimetal 26, the resetting-type switch contacts are thereby provided. At this time, the auxiliary reversing bimetal 27 has the higher set-temperature and will not be reversed to remain the auxiliary fixed and movable contacts 25 and 39 as closed but causing no trouble since the circuit is cut off by the opening of the main fixed and movable contacts 24 and 38.

When, on the other hand, the opening of the contacts is not realized at the first set-temperature due to, for example, a cracking of the main reversing bimetal 26 or fusing of the main fixed and movable contacts 24 and 38 and, accordingly, the temperature of the instrument including the thermal switch reaches the relatively higher second set-temperature which is such risky temperature as that causes the instrument to be broken or burnt to generate, the auxiliary reversing bimetal 27 is caused to reversely turn so as to push up through the relatively longer auxiliary tongue piece 41 the auxiliary contact-spring part 37, whereby the auxiliary movable contact 39 on the auxiliary contact-spring part 37 is separated from the auxiliary fixed contact 25 on the auxiliary outer terminal 16 to open the contacts and the circuit will be cut off.

When the auxiliary contact-spring part 37 is thus pushed up, its return preventing tongue piece 42 rides on the shelf surface 45 of the return-preventing shelf part 43 and, as a result, unless the return-preventing tongue piece 42 is removed from the shelf surface 45, the auxiliary fixed and movable contacts 25 and 39 will remain open, that is, the non-resetting type switch contacts are thus provided.

Figure 2:
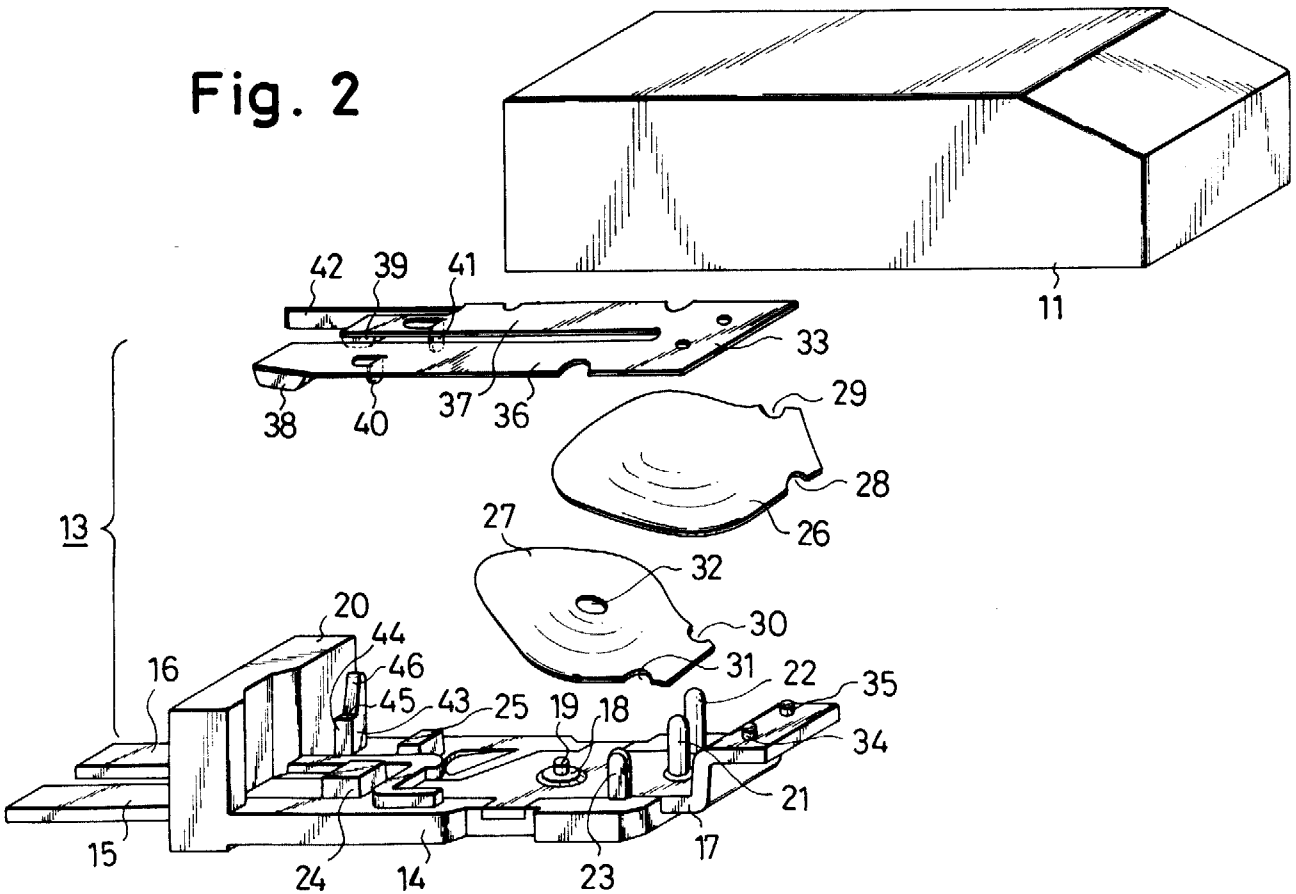
FIG. 2 is a perspective view as disassembled of a thermal switch in an embodiment according to the present invention.
Figure 3:
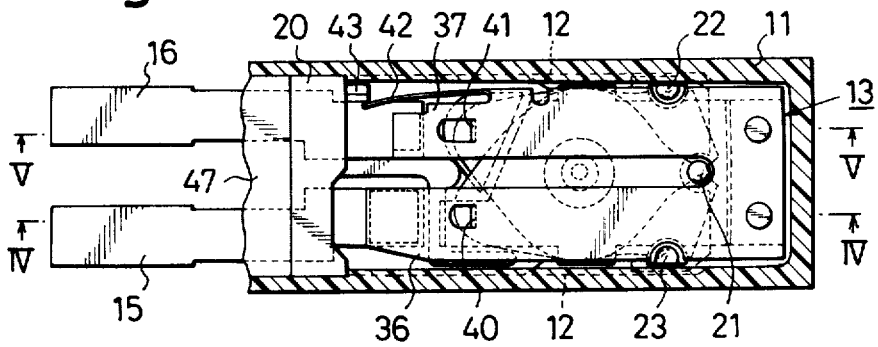
FIG. 3 is an internal plan view as assembled of the thermal switch in the embodiment of FIG. 2 with a part shown in section.

In the foregoing embodiment, further, as shown specifically in FIG. 2 or 3, the bimetals are held in position only at their base end portion with the supporting projections 21 and 22 engaged in the incisions 28 and 29 of the bimetals so that, even when the clearance C between the inner edge of these incisions and the projections is made the minimum, the bimetals may freely achieve the reversing operations. Consequently, respective abutting positions of the center of the bimetal 26 with the push-up projection 19 and of the end portion of the bimetal with the projections 21 and 22 or 23 and tongue pieces 40 and 41 as well do not deviate practically and the operations can be made remarkably stable. Since the both bimetals are disposed to mutually intersect the center line, it is made possible to render the operating length of the respective bimetals longer even when the thermal switch is minimized in size and, consequently, the operating amplitude of bimetal can be enlarged so that reliable contact switchings can be well achieved.

According to still another aspect ofthe present invention, the main and auxiliary reversing bimetals are parallelly arranged substantially in the same plane in the width direction, that is, with a horizontal positional relation, instead of such vertical relation as in the case of the foregoing embodiment, so that a double safety function can be also obtained. In another embodiment of the present invention shown in FIGS. 12 and 13, main and auxiliary contact spring parts 136 and 137 of a movable contact spring 133 fixed at one end to a base 114 of a switch body 113 are provided adjacent their free end respectively with a catching piece 128 or 130. On the other hand, a bimetal member is made to have mutually parallel bimetal parts of a main reversing bimetal part 126 having a relatively lower first set-temperature and an auxiliary reversing bimetal part 127 having a relatively higher second set-temperature, which are engaged respectively at the free end to each of the catching pieces 128 and 130 so as to control the spring forces of the main and auxiliary contact spring parts 136 and 137 respectively until the first set-temperature and second set-temperature are reached, and such bimetal member is secured at the common base part onto a corresponding base part of the movable contact spring 133 by means of dowels on a base 144.

When the atmospheric temperature reaches the first set-temperature, with the above arrangement, the main reversing bimetal part 126 operates to reverse and, when the second set-temperature is reached, the auxiliary reversing bimetal part 127 operates to reverse. Thus, the present embodiment has substantially the same function as of the foregoing embodiment in FIGS. 2 to 5. It will be readily understood by any skilled in the art that the auxiliary contact spring part can take the formation having the return-preventing tongue piece and return-preventing shelf part (not illustrated) employed in the embodiment of FIGS. 2 to 5.

According to another aspect of the present invention, an arrangement in which the operation of the auxiliary reversing bimetal is regarded as important is suggested in respect of the arrangement wherein the main and auxiliary reversing bimetals are arranged in a vertical relation. That is, according to another embodiment of the present invention shown in FIG. 14, the same auxiliary reversing bimetal 227 as in the embodiment of FIGS. 2 to 5 is arranged at a level higher than a main reversing bimetal 226, an auxiliary tongue piece 241 is extended to be shorter from an auxiliary contact spring part 237 while a main tongue piece 240 is extended longer from a main contact spring part 236. In this case, advantages are brought about in that the auxiliary reversing bimetal 227 can operate without being influenced at all by the main reversing bimetal 226 and a bimetal which is relatively lower in costs and is smaller in the reversing force can be employed as the auxiliary reversing bimetal 227.

According to still another aspect of the present invention, an arrangement wherein the bending stress applied to the main reversing bimetal which is high in the frequency of the reversing operation can be reduced is suggested. That is, in another embodiment of the present invention shown in FIG. 15, a projection 361 of substantially the same length as of a main tongue piece 340 is provided in the base part of an auxiliary contact spring part 337 so as to project downward at a position symmetrical with the main tongue piece 340 with respect to a small push-up projection 319. The other formation in this embodiment is substantially the same as that of the embodiment shown in FIGS. 2 to 5. According to the present embodiment, therefore, upon the reversing operation of the main bimetal 326, the same will contact at the center with the small push-up projection 319 and, as the main tongue piece 340 and projection 361 are in the positions inside both end edges of the main reversing bimetal 326, in contrast to the case where the main reversing bimetal 326 contacts at its base end edge directly with the auxiliary contact spring part 337, the bending stress applied to the main reversing bimetal 326 is reduced and the main reversing bimetal 326 can be effectively prevented from being subjected to cracking or the like.

Figure 16:
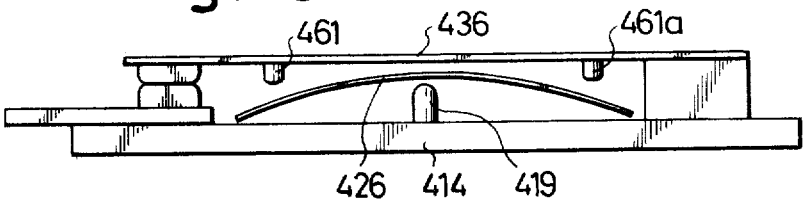
Figure 17:
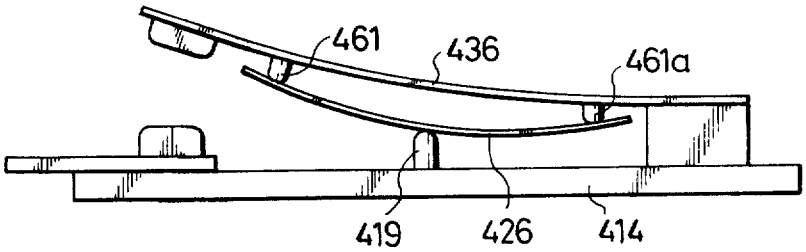

This arrangement of reduced bending stress can be applied also to a thermal switch wherein the main and auxiliary reversing bimetals are parallelly provided in the horizontal direction as in FIGS. 12 and 13. Referring to FIGS. 16 and 17, a push-up projection 419 is provided to project upward in the middle of a base 414 below a main contact spring part 436, and projections 461 and 461*a* positioned above and inside the both end edges of a main reversing bimetal 426 are provided to project downward on the lower surface of the main contact spring part 436 so that, when the main reversing bimetal 426 operates to reverse, the push-up projection 419 will contact the main reversing bimetal 426 in the central part, the projections 461 and 461*a* will contact the main reversing bimetal 426 inside the end edges, whereby the bending stress applied to the main reversing bimetal 426 can be reduced and substantially the same action as in the embodiment of FIG. 15 can be obtained.

Figure 18:
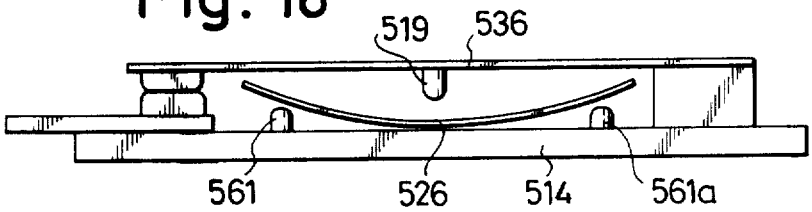
Figure 19:
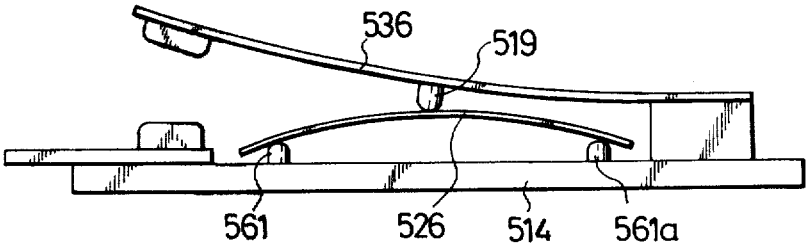

In the present invention, further various design modifications are possible. That is, even when projections 561 and 561*a* are provided to project upward on a base 514 so as to be positioned below inside the both end edges of a main reversing bimetal 526, as shown in FIGS. 18 and 19, and a pushdown projection 519 contacting the main reversing bimetal 526 at the central part is provided to project downward on the lower surface of the middle part of a main contact spring part 536, the same action as in the embodiment of FIG. 15 or FIGS. 16 and 17 can be obtained.

While in the respective embodiments described in the foregoing the bimetal member which reversely turns or leans back and forward has been referred to, the one which simply bends or bows responsive to heat so as to open and close the contacts. Further, it is also possible to provide on the movable contact spring a means for separating the main and auxiliary reversing bimetals, thus performing the same function as the small push-up projection, and the main and auxiliary tongue pieces provided as disclosed in the main and auxiliary contact spring parts may be made by an extrusion.

According to the present invention having such arrangement as described above, specifically a plurality of reversing bimetals having set-temperatures different from one another are parallelly provided either in vertical position relation or horizontal position relation, so that a multiple safety function can be provided to the thermal switch and the reliability and safety of the switch can be elevated to a remarkable extent. Further, even when a plurality of reversing bimetals are used, they can be arranged organically so that a thermal switch having a multiple safety function and yet compact can be obtained. As the base member is made by molding a synthetic resin on a single metal plate, a very high positional precision of the respective components can be well attained.

What is claimed is:

1. A thermal switch including a switch body comprising a base, a plurality of outer terminals held on said base to be electrically independent of each other and respectively having a fixed contact, a plurality of movable contact springs corresponding in number to said outer terminals and respectively having a movable contact contactable with each of said fixed contacts, respective said movable contact springs being electrically connected with each other, a movable-contact-spring fixing plate held onto the base for fixing said movable contact springs in mutually parallel relation in the horizontal direction, and a plurality of bimetals each having a set-temperature different from that of the other and operating respectively independently so as to separate the movable contact of one of the movable contact springs from the fixed contact, whereby one of the movable contact springs operated by one of said bimetals which has said set-temperature relatively lower than the other forms resetting-type switching contacts and the other of the springs of the set-temperature relatively higher forms non-resetting type switching contacts.

2. A thermal switch according to claim 1 wherein said outer terminals and movable-contact-spring fixing plate are formed as simultaneously punched out of a single conductive metal plate.

3. A thermal switch according to claim 1 wherein said outer terminals and movable contact springs are respectively in a pair, one of said pair of movable contact springs which is operated by said bimetal having said relatively lower set-temperature forms a main contact spring part, the other contact spring operated by said bimetal having said relatively higher set-temperature forms an auxiliary contact spring part, and said auxiliary contact part is provided with a return preventing tongue piece extended to be capable of riding on a return preventing shelf part provided as projected on said base so as to prevent return movement of the auxiliary contact spring part when the same is displaced by the bimetal of the higher set-temperature.

4. A thermal switch according to claim 1 wherein said outer terminals, bimetals and movable contact springs are provided respectively in a pair, one of said pair of movable contact springs operated by one of the bimetals having said relatively lower set-temperature forms a main contact spring part while the other movable contact spring operated by the other bimetal having said relatively higher set-temperature forms an auxiliary contact spring part, and said pair of bimetals are arranged in a vertical position relation between said base and respective said main and auxiliary contact spring parts.

5. A thermal switch according to claim 4 wherein respective said bimetals are so arranged that their center lines intersect each other and their tips define an angle with each other.

6. A thermal switch according to claim 4 wherein a set of incisions is made in the base part of respective said bimetal, three projections are erected on said base so that lines connecting them describe an isosceles triangle and one of said incisions in each bimetal is engaged commonly with the middle projection of said three projections and the other incisions are engaged with the two other projections so that the base parts of the respective bimetals will be positioned on the hypotenuses of said isosceles triangle.

7. A thermal switch according to claim 4 wherein a means for separating said bimetals from each other in said vertical relation is provided on the base.

8. A thermal switch according to claim 4 wherein a pair of means for transmitting an operation of each of said pair of bimetals to their opposing one of said main and auxiliary contact spring parts are provided respectively between each of the bimetals and its opposing one of the main and auxiliary contact spring parts, and said pair of transmitting means are different in the length in opposing direction of the bimetal and main or auxiliary contact spring part.

9. A thermal switch according to claim 1 wherein said outer terminals, bimetals and movable contact springs are provided respectively in a pair, said pair of movable contact springs are forming main and auxiliary contact spring parts respectively having a resiliency for separating said movable contact from said fixed contact, and said pair of bimetals are disposed to be horizontal in mutual positional relationship and engaged respectively with each of the main and auxiliary contact spring parts so as to restrain said resiliency of the spring part.

10. A thermal switch according to claim 1 which further comprises a first projecting means for contacting the center of each of said bimetals and a second projecting means for contacting each of the bimetals at its positions inside the both end edges upon reversing operation of the respective bimetals.

11. A thermal switch according to claim 4, wherein said pair of bimetals are respectively of an oval outline having incisions on both sides adjacent an end base part along the major axis of said outline, and said base has three projections spaced from each other for supporting each of the bimetals in said vertical position relationship with each of said incisions of the bimetals made substantially in the same dimensions as said projections and engaged thereto.

* * * * *